US008827506B2

(12) United States Patent
Osada et al.

(10) Patent No.: US 8,827,506 B2
(45) Date of Patent: Sep. 9, 2014

(54) LUMINAIRE

(75) Inventors: Takeshi Osada, Kanagawa-ken (JP); Satoshi Watanabe, Kanagawa-ken (JP); Keiichi Shimizu, Kanagawa-ken (JP); Shigeru Osawa, Kanagawa-ken (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 0 days.

(21) Appl. No.: 13/496,193

(22) PCT Filed: Jun. 21, 2011

(86) PCT No.: PCT/JP2011/064110

§ 371 (c)(1),
(2), (4) Date: Aug. 14, 2012

(87) PCT Pub. No.: WO2011/162231

PCT Pub. Date: Dec. 29, 2011

(65) Prior Publication Data

US 2013/0083511 A1 Apr. 4, 2013

(30) Foreign Application Priority Data

Jun. 25, 2010 (JP) ..... P2010-144428

(51) Int. Cl.

| | |
|---|---|
| ***F21V 15/01*** | (2006.01) |
| ***F21V 19/00*** | (2006.01) |
| ***H01R 13/73*** | (2006.01) |
| ***F21K 99/00*** | (2010.01) |
| ***F21S 8/02*** | (2006.01) |
| *F21Y 101/02* | (2006.01) |
| *F21V 29/00* | (2006.01) |

(52) U.S. Cl.

CPC ..... *F21V 19/00* (2013.01); *F21V 15/01* (2013.01); *F21V 19/006* (2013.01); *H01R 13/73* (2013.01); *F21V 19/0035* (2013.01); *F21Y 2101/02* (2013.01); *F21K 9/30* (2013.01); *F21V 29/2206* (2013.01); *F21S 8/026* (2013.01); *F21V 15/011* (2013.01)

USPC ..... 362/368; 362/148; 362/365

(58) Field of Classification Search

USPC ..... 362/148, 150, 364–365, 368, 370–371

See application file for complete search history.

(56) References Cited

U.S. PATENT DOCUMENTS 5,921,655 A * 7/1999 Nassim ..... 362/147

(Continued)

FOREIGN PATENT DOCUMENTS

EP 2-469-161 A1 6/2012

(Continued)

OTHER PUBLICATIONS

Korean Office Action, Application No. 10-2012-7006817, dated Jul. 24, 2013.

(Continued)

*Primary Examiner* — Diane Lee
*Assistant Examiner* — Gerald J Sufleta, II
(74) *Attorney, Agent, or Firm* — Patterson & Sheridan LLP

(57) ABSTRACT

A luminaire capable of contacting a lamp device to a luminaire main body is provided.

A luminaire includes a luminaire main body that includes an abutment portion in which heat is transferred and a mounting receiving portion, a socket device that includes a socket main body having an opening portion, an engagement receiving portion which is provided in the opening portion, a mounting member which is fixed to the mounting receiving portion, a receiving portion which receives an elastic member generating an elastic force between the socket main body and the mounting member, and a connection portion which is electrically connected to an external power source, and is mounted so as to move in the elasticity direction of the elastic member with respect to the luminaire main body by the mounting member, and a lamp device that includes a contact portion which contacts the abutment portion, an engagement portion which engages with the engagement receiving portion, and a lamp side connection portion which is electrically connected to the connection portion, wherein the abutment portion of the luminaire main body and the contact portion of the lamp device closely contact with each other by the elastic force of the elastic member according to an operation in which the engagement portion of the lamp device and the engagement receiving portion of the socket device are engaged with each other.

15 Claims, 10 Drawing Sheets

(56) References Cited

U.S. PATENT DOCUMENTS

| | | | | |
|---|---|---|---|---|
| 8,517,325 | B2 * | 8/2013 | Verma et al. | 248/342 |
| 2011/0267827 | A1 * | 11/2011 | Wein | 362/368 |

FOREIGN PATENT DOCUMENTS

| | | | | |
|---|---|---|---|---|
| JP | 2010-040364 | | | 2/2010 |
| JP | 2010-129487 | | | 6/2010 |
| JP | 2010-129487 | A | | 6/2010 |
| JP | 2010129487 | A | * | 6/2010 |

OTHER PUBLICATIONS

European Search Report Patent Application No. 11798115.9 dated Jul. 10, 2013.

International Search Report and Written Opinion for application No. PCT/JP2011/064110 dated Oct. 4, 2011.

* cited by examiner

LUMINAIRE

TECHNICAL FIELD

Embodiments of the present invention relate to a socket device, an electrical appliance which includes a luminaire main body and the socket device, or a luminaire which includes the socket device, the luminaire main body, and a lamp device.

BACKGROUND ART

According to the applicant of the present invention, a luminaire is suggested in which a luminaire main body includes a lamp device which uses a GX 53 type cap standardized by an IEC (International Electrotechnical Commission) and has a light emitting diode as the light source, and a socket device for the GX 53 type cap on which the lamp device is detachably mounted (refer to PTL 1). The luminaire includes a cap portion of the lamp device which is held to the socket device, and a pressing body which presses the luminaire main body being a radiator in a contact direction.

CITATION LIST

Patent Literature

[PTL 1] JP-A-2010-129487 (Page 6 and FIG. 1)

SUMMARY OF INVENTION

Technical Problem

An object of an embodiment of the present invention is to provide a luminaire, a socket device, and an electrical appliance for contacting a lamp device to a luminaire main body.

Solution to Problem

A luminaire of an embodiment of the present invention includes: a luminaire main body that includes an abutment portion in which heat is transferred and a mounting receiving portion; a socket device that includes a socket main body having an opening portion, an engagement receiving portion which is provided in the opening portion, a mounting member which is fixed to the mounting receiving portion, a receiving portion which receives an elastic member generating an elastic force between the socket main body and the mounting member, and a connection portion which is electrically connected to an external power source, and is mounted so as to move in an elasticity direction of the elastic member with respect to the luminaire main body by the mounting member; and a lamp device that includes a contact portion which contacts the abutment portion, an engagement portion which engages with the engagement receiving portion, and a lamp side connection portion which is electrically connected to the connection portion, wherein the abutment portion of the luminaire main body and the contact portion of the lamp device closely contact with each other by the elastic force of the elastic member according to an operation in which the engagement portion of the lamp device and the engagement receiving portion of the socket device are engaged with each other.

Advantageous Effects of Invention

According to the embodiment of the present invention, it is possible to transfer heat which is generated in the lamp device to the luminaire main body.

DESCRIPTION OF EMBODIMENTS

Figure 1:
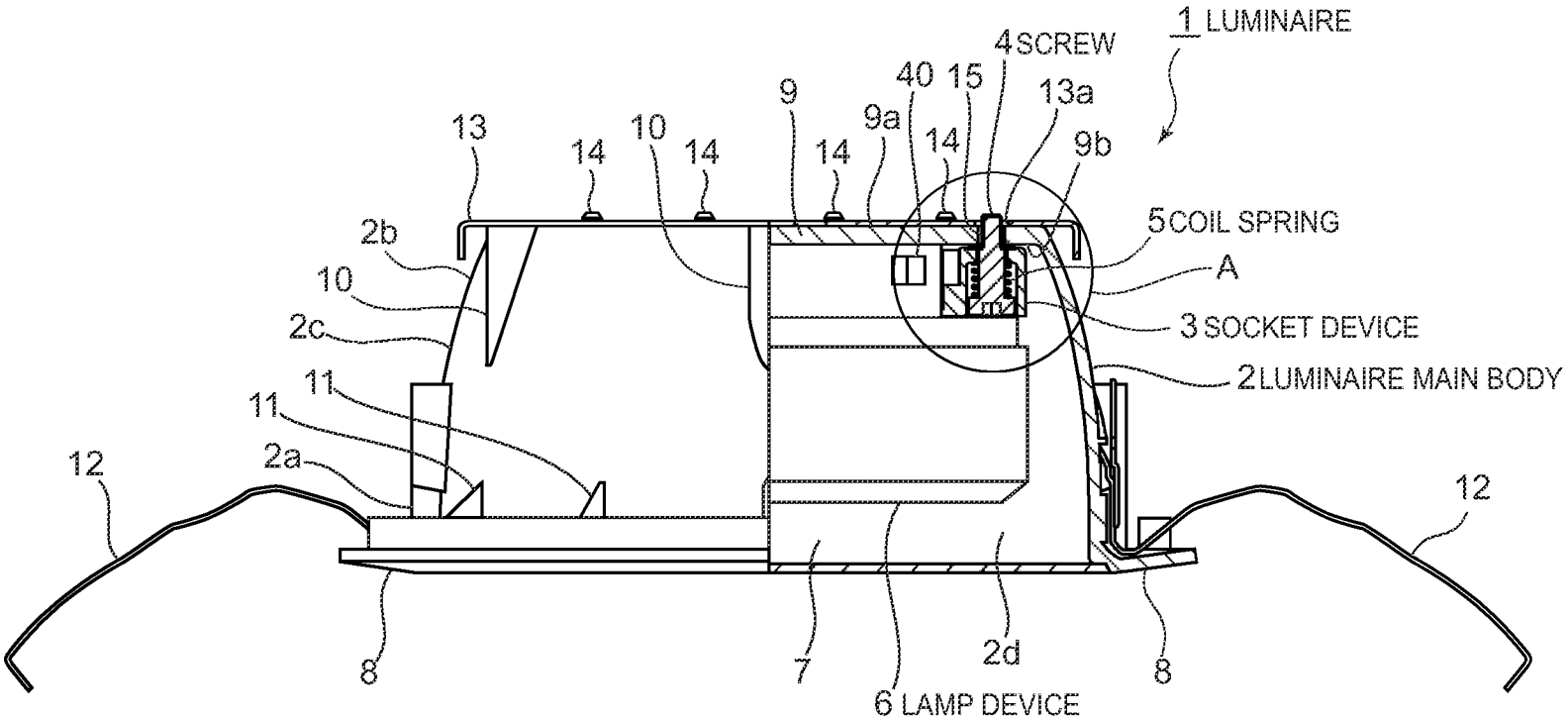
FIG. 1 is a schematic vertical cross-sectional view in which a luminaire showing a first embodiment of the present invention is partially cut.

A luminaire of an embodiment includes: a luminaire main body that includes an abutment portion in which heat is transferred and a mounting receiving portion; a socket device that includes a socket main body having an opening portion, an engagement receiving portion which is provided in the opening portion, a mounting member which is fixed to the mounting receiving portion, a receiving portion which receives an elastic member generating an elastic force between the socket main body and the mounting member, and a connection portion which is electrically connected to an external power source, and is mounted so as to move in an elasticity direction of the elastic member with respect to the luminaire main body by the mounting member; and a lamp device that includes a contact portion which contacts the abutment portion, an engagement portion which engages with the engagement receiving portion, and a lamp side connection portion which is electrically connected to the connection portion, wherein the luminaire main body and the lamp device closely contact each other by the elastic force of the elastic member according to an operation in which the engagement portion of the lamp device and the engagement receiving portion of the socket device are engaged with each other.

The luminaire main body of the embodiment may preferably be formed of materials such as aluminum die-cast which has improved thermal conductivity and heat dissipation and less thermal deformation, and a plurality of radiating fins may be provided on the outer circumferential surface of the luminaire main body.

In addition, the luminaire main body may be configured so as to include a planar plate portion in which the mounting receiving portion is provided. Moreover, the luminaire main body may be configured of only a flat plate, and in general, when the luminaire main body is formed in a housing or a box shape, the bottom plate or the top plate thereof may be a flat plate portion.

If the abutment portion includes a function capable of effectively transferring heat, any one may be used. If the abutment portion is configured of a material with good thermal conductivity and is configured so as to transfer heat by contacting the contact portion, the abutment portion may include various shapes. For example, the abutment portion may be integrally formed with the luminaire main body or may be formed so as to be separated from the luminaire main body. Moreover, the surface in which the abutment portion contacts the contact portion may be configured of a planar shape and may be configured so as to engage with the abutment portion. In addition, the entire luminaire main body may be configured of a heat sink and a portion of the luminaire main body may be configured of a heat sink. In this case, it is possible to dissipate heat from the heat sink through the abutment portion.

The mounting member is fixed to the mounting receiving portion. The socket device is mounted on the luminaire main body by the mounting member.

If the mounting receiving portion of the luminaire main body and the mounting member of the socket device include a fixing function, any one may be used. As mechanical fixing means which can mount and detach, a screw and a screw hole, a bolt and a nut, fixing means using fitting, and the like may be used. Moreover, the mounting receiving portion and the mounting member may be fixed by chemical attachment means such as an adhesive or caulking.

If the engagement receiving portion of the socket device and the engagement portion of the lamp device include an engaging function, any one may be used. As a mountable and detachable mechanical fixing means, a combination of the engagement portion and the engagement receiving portion, for example, a combination of a locking convex portion and a locking concave portion may be used.

The lamp device is attached to and detached from the socket device of the embodiment, and the socket device is configured so as to include the socket main body, the engagement receiving portion, the receiving portion, and the connection portion.

The socket main body includes the circular opening portion in the center region. For example, the socket main body is annularly formed, and a reinforcement member such as a rib may be formed on the other surfaces or the edge portion.

As long as the receiving portion includes a function which receives the elastic member and the mounting member, any configuration may be used. A cylindrical column body or a cylindrical concave portion which is formed in the main body of the socket device may be used. In addition, for example, if a screw which is the mounting member is concentrically disposed in a coil which is the elastic member and the screw is inserted into the coil, this is advantageous on a space-saving. Moreover, the screw and the coil may be disposed in parallel. As long as the connection portion and the lamp side connection portion include a function which electrically connects the external power source and the lamp device to each other, any configuration may be used. For example, a pin and a connector, or an electric connection between a pattern formed on a substrate and a contact pin may be used.

As long as the elastic member includes an elastic force, any configuration may be used. As an elastic body which generates elastic restoring force by compression, a coil, a spring, an air cushion, rubber, and polymeric materials such as rubber-rubber may be used.

In order to transfer the heat of the lamp main body, if the contact portion includes a function which contacts the abutment portion of the luminaire main body, any one may be used. A protrusion is provided on the lamp main body, the upper surface of the protrusion may be a contact surface, and a flat plate shaped separated member is provided and the member may be used as the contact portion. When the contact portion is configured of the separated member, it is preferable that the member have electrical insulating property and elasticity such as silicon and lubricity on the contact surface with the abutment portion. Moreover, the flat plate shaped member may have a polygonal shape or a circular shape. In addition, when the contact portion is configured in a hexagonal flat plate shape, handling of the member is improved, and a contact area can be secured.

Hereinafter, embodiments will be described with reference to the drawings.

First Embodiment

A luminaire of a first embodiment is configured as shown in FIGS. 1 to 5.

In FIG. 1, the luminaire 1 is a downlight which is embedded into a ceiling or the like, and is configured so as to include a luminaire main body 2, a socket device 3, a screw 4 which is a mounting member, a coil spring 5 which is an elastic member, and a lamp device 6.

The luminaire main body 2 is molded by aluminum die-casting, and is formed in a box body having a substantially cylindrical shape which includes an opening portion 7 and an annular flange portion 8 protruding outward in a lower end side 2*a* and an abutment portion 9 which closes an upper end side 2*b* and is formed in the shape of plane in the upper end side 2*b*. In addition, a plurality of reinforcement pieces 10 and 11 which also serve as a radiating fin are formed in an outer surface 2*c* of the luminaire main body 2. Moreover, a pair of mounting springs 12 and 12 which interpose a ceiling or the like between the flange portion 8 and the mounting spring 12 is provided in the lower end side 2*a* of the outer surface 2*c*. In addition, for example, a reflection surface is formed on an inner surface 2*d* of the luminaire main body 2 by a white paint.

For example, a top plate 13 is mounted on an outer surface 9*a* of the abutment portion 9 by rivets 14.

The top plate 13 is extended to the outside of the luminaire main body 2, and a terminal board (not shown) is mounted on the lower surface side of the top plate. A power line from an external power source is connected to the terminal board.

In addition, a plurality of screw holes 15 (only one is shown in FIG. 1) which are a mounting receiving portion penetrating from an inner surface 9*b* to the outer surface 9*a* is provided in the abutment portion 9. The socket device 3 is mounted into the screw hole 15 by using the screw 4 and the coil spring 5. Moreover, the lamp device 6 is mounted on the socket device 3. In addition, a hole 13*a* for avoiding interference of the screw 4 is formed in the flat plate 13.

Figure 3A:
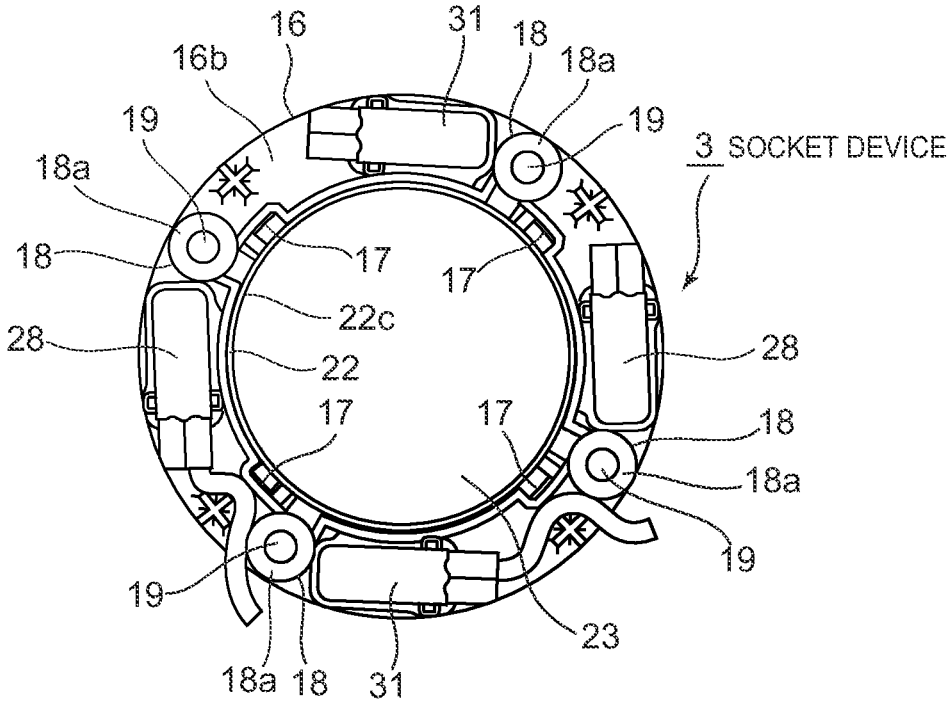
FIG. 3 shows a socket device in the first embodiment, (*a*) is a schematic top view, and (*b*) is a schematic bottom view.
Figure 3B:
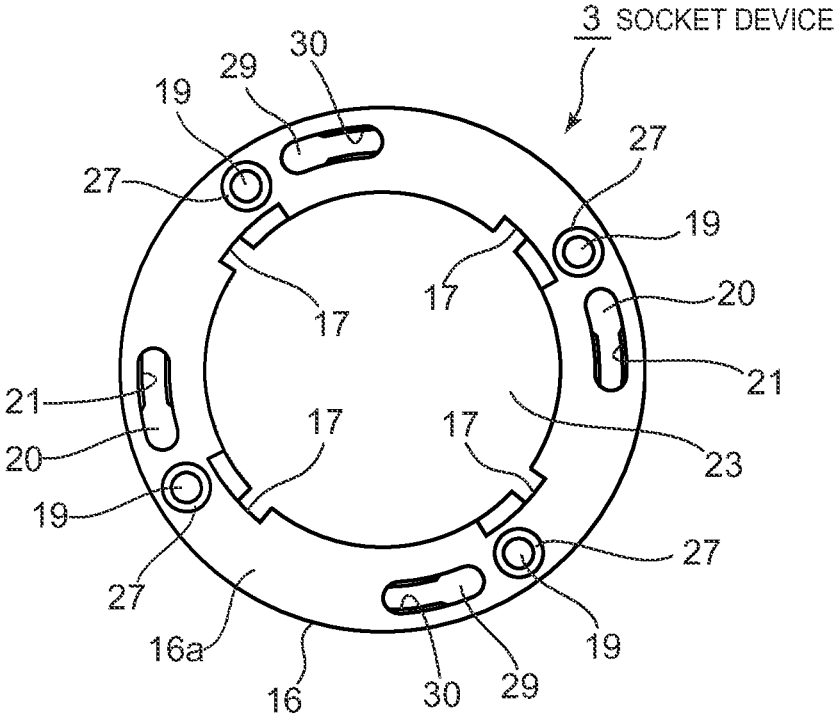

The socket device 3 is formed in a substantially annular shape, and as shown in FIG. 3, is configured so as to include a socket main body 16, engagement receiving portions 17, receiving portions 18, penetrating holes 19, a pair of connection holes 20 and 20, and carriers 21 and 21.

The socket main body 16 is formed of an electrically insulating synthetic resin, for example, polycarbonate (PC) resin, one surface (lower surface) 16*a* of the socket main body is formed in the shape of plane, and a cylindrical portion 22 having a predetermined thickness and height is provided on the other surface (upper surface) 16*b*. The cylindrical portion 22 is formed so as to include a circular opening 23 in the center region of the one surface 16*a* of the socket main body 16.

Figure 4:
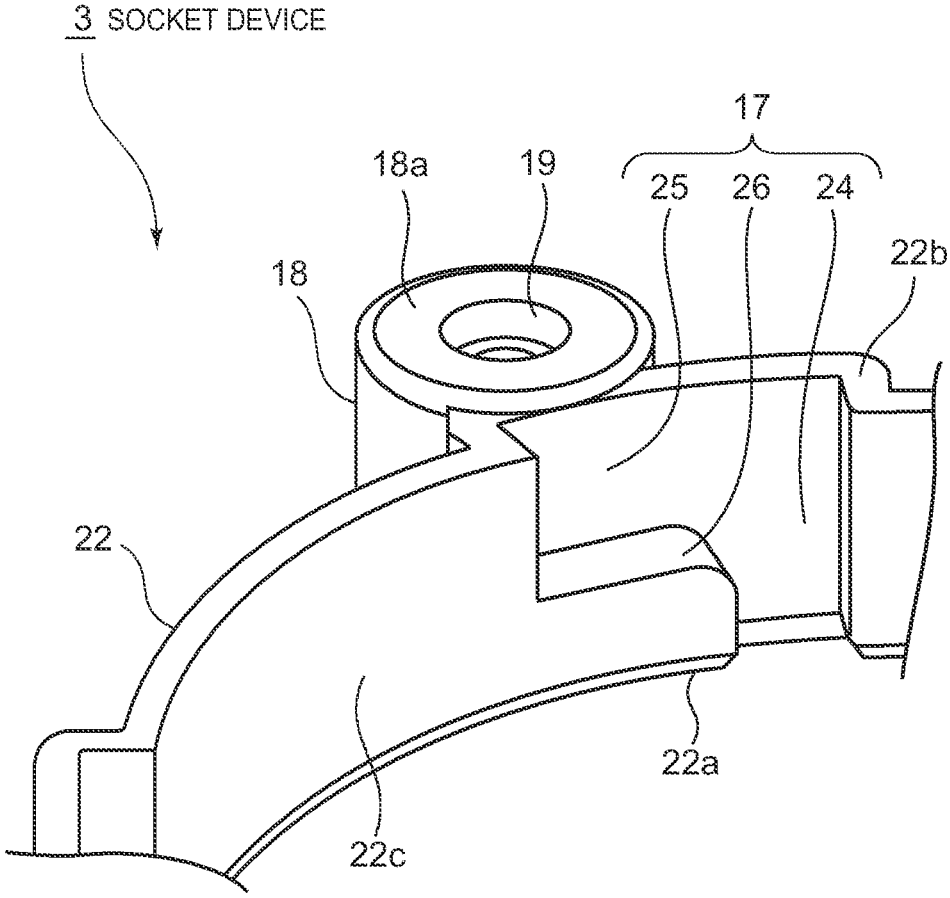
FIG. 4 shows a schematic perspective view showing a portion of an inner wall surface of the socket device in the first embodiment.

The engagement receiving portion 17 is formed on an inner wall surface 22*c* of the cylindrical portion 22. That is, as shown in FIG. 4, the engagement receiving portion 17 is formed in a substantially L shape which includes vertical groove portion 24 which is formed further to the outside than the inner wall surface of the cylindrical portion 22 and is formed in the protrusion direction of the cylindrical portion 22, and horizontal groove portion 25 which communicates with the vertical groove portion 24 and is formed in the circumferential direction of the cylindrical portion 22. The vertical groove portion 24 is formed in a predetermined width and depth from a lower surface 22*a* of the cylindrical portion 22 which is the one surface 16*a* of the socket main body 16 to an upper surface 22*b* of the cylindrical portion 22. Moreover, the horizontal groove portion 25 communicates with the vertical groove portion 24, and is formed at a predetermined length with the same depth as that of the vertical groove portion 24 on the upper surface 22*b* side in the circumferential direction of the cylindrical portion 22.

Moreover, an inclined portion 26 having a smooth curved surface is formed in boundary portion between the vertical groove portion 24 and the horizontal groove portion 25 of the cylindrical portion 22. The width, the depth, or the like of the engagement receiving portion 17 are set so that an engagement portion described below of the lamp device 6 is engaged. In addition, a protrusion described below of the lamp device 6 approach the cylindrical portion 22 and is inserted.

Figure 2:
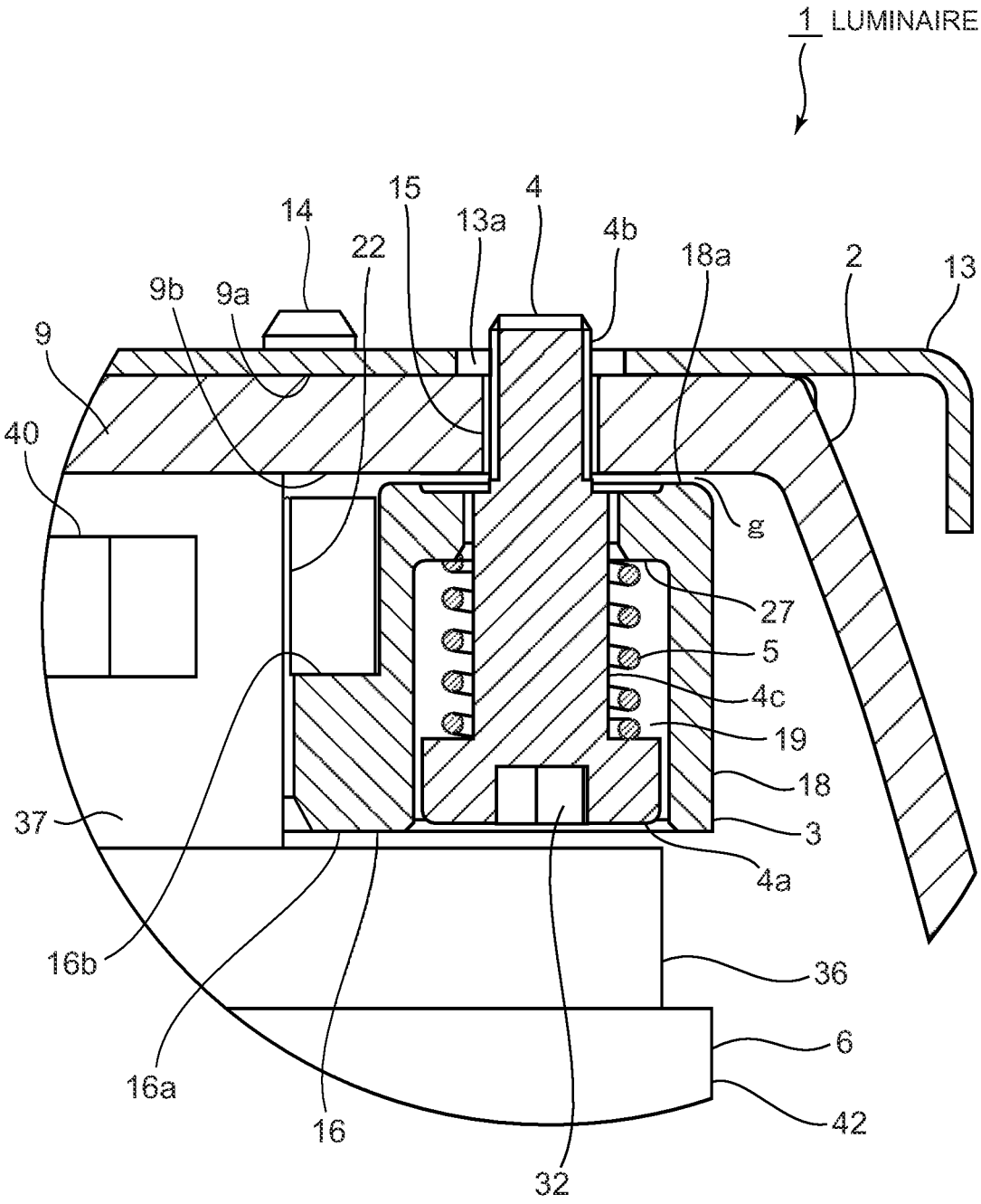
FIG. 2 is an enlarged view of A portion in the first embodiment in FIG. 1.

The receiving portions 18 are provided so as to correspond to screw holes 15 of the luminaire main body 2, and as shown in FIG. 3(*a*), the receiving portions 18 are integrally erected to the socket main body 16 on the other surface 16*b* side of the socket main body 16. In addition, the receiving portions 18 are formed in a cylindrical shape, and four receiving portions 18 are provided at regular intervals of 90° in the circumferential direction of the cylindrical portion 22. Moreover, as shown in FIG. 2, the heights of the receiving portions 18 from the socket main body 16 are equal to or more than the height of the cylindrical portion 22.

The coil spring 5 and the screw 4 are inserted into the penetrating holes 19, the cross-sections of the penetrating holes are formed in circular holes in the receiving portions 18, and the penetrating holes are formed so as to penetrate the receiving portions 18 from the one surface 16*a* of the socket main body 16 to the upper surface 18*a* of the receiving portions 18. Moreover, diameters of the penetrating holes 19 are formed so as to be larger in the socket main body 16 side, the diameters of the penetrating holes are formed so as to be smaller in the side (non-socket main body side or upper surface 18*a* side of receiving portions 18) opposite to the socket main body 16, and the penetrating holes are formed so as include step portions 27 in the middle. That is, the penetrating holes are formed at a size in which head portions 4*a* of the screws 4 can insert in the socket main body 16 side, and are formed at a size in which the head portions 4*a* of the screws 4 cannot insert and screwed portions 4*b* of the screws 4 can insert in the side opposite to the socket main body 16. In addition, since the penetrating holes 19 and the step portions 27 are formed by the receiving portions 18, hereinafter, the step portions 27 are also referred to the receiving portions 18.

In addition, depths of the penetrating holes 19 from the one surface 16*a* of the socket main body 16 to the step portions 27 are set so that the head portions 4*a* of the screws 4 do not protrude from the one surface 16*a* of the socket main body 16 when the socket device 3 is mounted on the luminaire main body 2. That is, the head portions 4*a* of the screws 4 are configured so as not to protrude from the side on which the lamp device 6 of the socket device 3 is mounted.

In FIG. 3, the pair of connection holes 20 and 20 which is a connection portion is provided so as to correspond to a pair of connection pins described below of the lamp device 6, and is formed so that the pair of connection pins is inserted into the one surface 16*a* side of the socket main body 16. Moreover, the pair of connection holes is formed in a long hole having a substantially arc shape so that the pair of connection pins moves according to rotation of the lamp device 6. In addition, the pair of connection holes 20 and 20 is provided at 180° rotationally symmetrical positions of the socket main body 16.

Each of the carriers 21 and 21 which are a connection portion is provided in the socket main body 16 corresponding to the pair of connection holes 20 and 20. Moreover, each of the carriers 21 and 21 is provided from the middles of the connection holes 20 and 20 to one end sides so as to interpose the pair of connection pins and electrically connect when the lamp device 6 is rotated at the pair of connection pins of the lamp device 6 which is inserted into the pair of connection holes 20 and 20. As shown in FIG. 3(*a*), the carriers 21 and 21 are connected to power connectors 28 and 28 which are connection portions and are mounted on the socket main body 16 in the other surface 16*b* side of the socket main body 16, and are also electrically connected to an external power source which is input to the socket device 3.

Moreover, as shown in FIG. 3(*b*), a pair of connection holes 29 and 29 and a pair of carriers 30 and 30, which are formed similarly to each of the pair of connection holes 20 and 20 and the pair of carriers 21 and 21, are provided in the socket main body 16. The pair of connection holes 29 and 29 is provided at 180° rotationally symmetrical positions of the socket main body 16 and at positions of rotational symmetry of 90° with respect to the pair of connection holes 20 and 20. As shown in FIG. 3(*a*), the carriers 30 and 30 are connected to communication connectors 31 and 31 which are mounted on the other surface 16*b* side of the socket main body 16. The communication connections 31 and 31 are connected to an external light control device which sends a light control signal. Moreover, as shown in FIG. 3, each of the carriers 21 and 30 is disposed in positions away from the receiving portions 18 of the connection holes 20 and 29 which are formed in an arc shape along the circumferential direction of the socket main body 16. That is, each of the receiving portions 18, the connection holes 20, and the carriers 21 is disposed on the circumference of the socket main body 16. In addition, the receiving portions 18 are configured so as not be positioned on the extensions of the power lines which are extended from the power connectors 28.

As shown in FIG. 2, the screw 4 is mounted on the luminaire main body 2. The screw 4 includes the head portion 4*a*, the screwed portion 4*b* and an intermediate portion 4*c*. The diameter of the intermediate portion 4*c* is smaller than that of the head portion 4*a* and is larger than that of the screwed portion 4*b*. In addition, the intermediate portion 4*c* is formed in a size which can be inserted into the small diameter portions of the penetrating holes 19 which are formed in the receiving portions 18. A hexagonal hole 32 into which tools such as a hexagonal wrench are inserted is formed in the head portion 4*a*. The screwed portion 4*b* is formed so as to be screwed to the screw hole 15 which is formed in the luminaire main body 2. In this way, the screw 4 is formed in a set screw having the hexagonal hole 32.

The screwed portion 4*b* and the intermediate portion 4*c* of the screw 4 are inserted into the inner portion side of the coil spring 5, and the outer diameter of the screwed portion is formed so as to be larger than the smaller diameter portion of the penetrating hole 19 and to be smaller than the head portion 4*a* of the screw 4. That is, the coil spring 5 is formed so that the expanding and contracting directions are sandwiched by the head portion 4*a* of the screw 4 and the step portion 27 which is boundary between the large diameter portion and the small diameter portion of the penetrating hole 19.

The coil spring 5 is inserted into the penetrating hole 19 of the socket device 3 from the one surface 16*a* side of the socket main body 16. In addition, the coil spring is pressed to the head portion 4*a* of the screw 4 which is screwed to the screw hole 15 of the luminaire main body 2 and abuts the step portion 27 of the receiving portion 18. Moreover, the coil spring is compressed as the screw 4 is screwed to the screw hole 15 of the luminaire main body 2.

In the coil spring 5, elastic restoring force is generated according to the compression, and the elastic restoring force is increased as amount of the compression is increased. Since the screwed portion 4*b* of the screw 4 is screwed to the screw hole 15 of the luminaire main body 2 and is fixed to the luminaire main body 2, an elastic force is generated between the head portion 4*a* of the screw 4 and the step portion 27 of the receiving portion 18 by the elastic restoring force which is generated in the coil spring 5. That is, an elastic force is generated between the screw 4 and the socket device 3. Thereby, the coil spring 5 presses the receiving portion 18 to the luminaire main body 2 side, and the upper surface 18*a* of the receiving portion 18 is formed so as to abut the inner surface 9*b* of the abutment portion 9 of the luminaire main body 2. Moreover, the head portion 4*a* is screwed to the luminaire main body 2 so as not to protrude from the one surface 16*a* of the socket main body 16 in a state where the mounting position of the screw 4 to the luminaire main body 2 is regulated by the intermediate portion 4*c*.

In this way, due to the fact that the screw 4 is mounted on the luminaire main body 2 so as to be accommodated into the penetrating hole 19, the socket device 3 is mounted on the flat surface portion 9 of the luminaire main body 2. At this time, the coil spring 5 is provided so as to be compressed. The lamp device 6 is detachably mounted on the socket device 3.

Figure 5A:
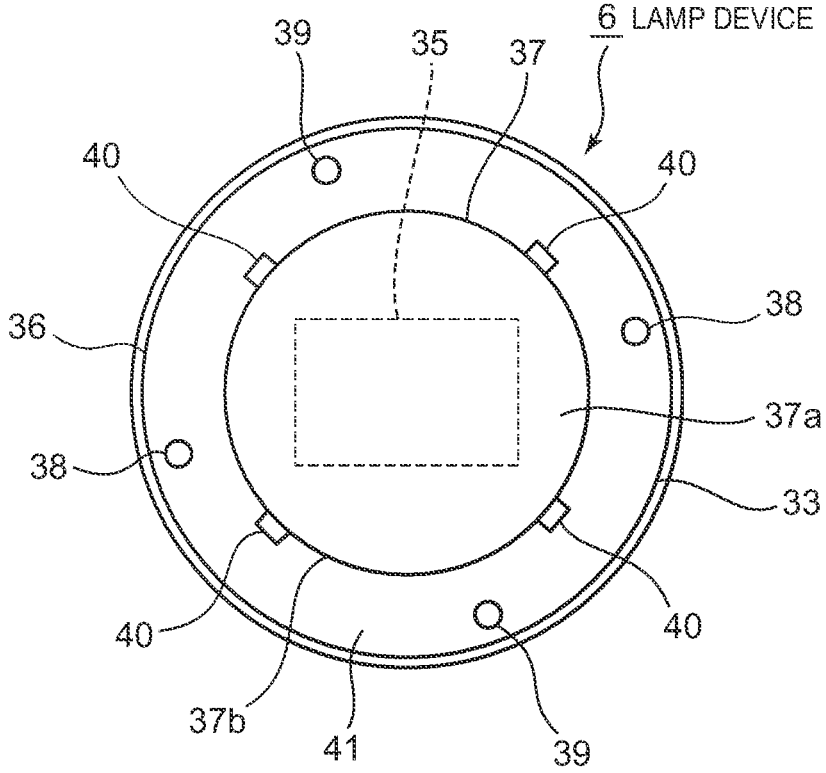
FIG. 5 shows a lamp device of the first embodiment, (*a*) is a schematic top view, and (*b*) is a schematic side view.
Figure 5B:
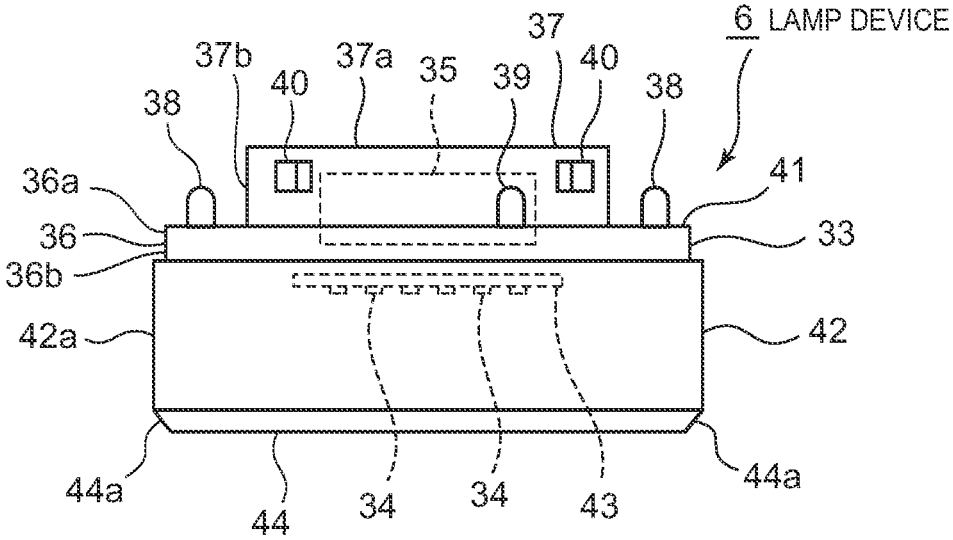

As shown in FIG. 5, the lamp device 6 is configured so as to include a cap main body 33, illumination lamps 34 and a light device 35. Moreover, the cap main body 33 is configured so as to include a base 36, a protrusion 37, a pair of connection pins 38 and 38, another pair of connection pins 39 and 39, and engagement portions 40.

The base 36 is formed in a cylindrical shape, and one end side 36*a* of the base is formed on a flat surface portion 41. The protrusion 37 protrudes upward from the center region of the flat surface portion 41 of the base 36, and is formed in a cylindrical shape which includes a planar upper surface 37*a* as a contact portion. In addition, the protrusion 37 approaches the inner wall surface 22*c* of the cylindrical portion 22 of the socket device 3 and is formed so as to be inserted into the cylindrical portion 22. Moreover, the height of the protrusion 37 is formed so as to be slightly greater than the cylindrical portion 22 (shown in FIG. 2).

The pair of connection pins 38 and 38 is provided so as to correspond to the pair of connection holes 20 and 20 of the socket device 3, protrudes upward from the flat surface portion 41 of the base 36 by a predetermined length, and is connected to an input side of the light device 35 by a lead wire (not shown). When the lamp device 6 is mounted on the socket device 3, the pair of connection pins 38 and 38 is inserted into the pair of connection holes 20 and 20, thereafter, the pair of connection pins is electrically connected to the carriers 21 and 21 by the rotation of the lamp device 6.

The other pair of connection pins 39 and 39 is provided so as to correspond to the other pair of the connection holes 29 and 29 of the socket device 3, protrudes similar to the pair of connection pins 38 and 38, and is connected to the input side of the light device 35 by a lead wire (not shown). When the lamp device 6 is mounted on the socket device 3, the other pair of connection pins 39 and 39 is inserted into the other pair of connection holes 29 and 29, thereafter, the other pair of connection pins is electrically connected to the carriers 30 and 30 by the rotation of the lamp device 6.

The engagement portions 40 protrude to an outer wall surface 37*b* of the protrusion 37, and four engagement portions 40 are formed so as to engage with the engagement receiving portions 17 of the socket device 3. When the protrusion 37 is inserted into the cylindrical portion 22 of the socket device 3, four engagement portions 40 are inserted to the vertical groove portions 24 of the engagement receiving portions 17 which are formed in the cylindrical portion 22. Moreover, the engagement portions are inserted to the cylindrical portion 22 and engage with the horizontal groove portions 25 of the engagement receiving portions 17 when the lamp device 6 is rotated. Thereby, the lamp device 6 is supported to the socket device 3 and mounted. At this time, the height of the protrusion 37 from the flat surface portion 41 of the base 36 is set so that the upper surface 37*a* of the protrusion 37 abuts the abutment portion 9 of the luminaire main body 2.

The illumination lamps 34 are provided in an inner portion of a light source main body 42 having a cylindrical shape which is provided to the other end side 36*b* of the base 36. In addition, the illumination lamps 34 are formed of a plurality of light emitting diodes, and are configured so as to be mounted on a substrate 43 which is mounted on the lower plate portion (not shown) of the light source main body 42. For example, the illumination lamps 34 radiate a white light. The white light is radiated so as to transmit a translucent globe 44 which is mounted on the light source main body 42.

In addition, for example, the base 36 side of an outer circumferential surface 42*a* of the light source main body 42 is formed in a heat radiating portion having a knurled structure. Moreover, when the lamp device 6 is mounted on the socket device 3 by a hand, a knob (not shown) for preventing slipping is provided on a circumferential edge 44*a* of the globe 44.

The light device 35 is disposed in the inner portion of the base 36 of the cap main body 33 and the protrusion 37. Moreover, the light device is formed using a known circuit in which power is supplied from the external power source through the pair of connection pins 38 and 38 and operated and the illumination lamps 34 are lighted. In addition, the light control signal is input from the light control device through the other pair of connection pins 39 and 39, and the light device is formed so as to dimly light the illumination lamps 34.

Hereinafter, effects of the first embodiment of the present invention will be described.

The socket device 3 is mounted as described in FIGS. 1 and 2 by the screw 4 and the coil spring 5 which are attachment means. In addition, the lamp device 6 is mounted on the socket device 3.

When the lamp device 6 is mounted on the socket device 3, for example, the knob portion of the outer circumferential edge of the globe 44 is gripped by hand, or the like, and first, the upper surface 37*a* of the protrusion 37 is inserted into the cylindrical portion 22 of the socket device 3. In addition, a plurality of engagement portions 40 which are provided on the outer wall surface 37*b* of the protrusion 37 are positioned at and inserted into the vertical groove portions 24 of the engagement receiving portions 17 which are provided on the cylindrical portion 22. The engagement portions 40 are engaged with the vertical groove portions 24 of the engagement receiving portions 17.

Moreover, if the lamp device 6 moves the luminaire main body 2 side, the outer wall surface 37*b* of the protrusion 37 moves along the inner wall surface 22*c* of the cylindrical portion 22, the engagement portions 40 moves along the vertical groove portions 24 of the engagement receiving portions 17, and the upper surface 37*a* of the protrusion 37 abuts the inner surface 9*b* of the abutment portion 9 of the luminaire main body 2. In the above state, if the lamp device 6 is rotated in the circumferential direction of the cylindrical portion 22, the engagement portions 40 climb over the inclined portions 26 of the engagement receiving portions 17 and are engaged with the horizontal groove portions 25.

Since the upper surface 37*a* of the protrusion 37 abuts the abutment portion 9 of the luminaire main body 2, the engagement portions 40 act so as to press the socket device 3 to the side opposite to the luminaire main body 2. At this time, since the screw 4 of the attachment means is fixed to the luminaire main body 2, the coil spring 5 is compressed, and the socket device 3 is pressed to the side opposite to the luminaire main body 2. As shown in FIG. 2, a gap g is formed between the upper surface 18*a* of the receiving portion 18 of the socket device 3 and the inner surface 9*b* of the abutment portion 9 of the luminaire main body 2.

Moreover, the elastic restoring force is increased as much as the coil spring 5 is compressed, and the coil spring 5 presses the step portion 27 of the receiving portion 18 and presses the socket device 3 to the luminaire main body 2 side. The pressing force presses the lamp device 6 to the luminaire main body 2 side through the engagement portions 40 which are engaged with the engagement receiving portions 17 of the socket device 3. Since the upper surface 37*a* of the protrusion 37 abuts the abutment portion 9 of the luminaire main body 2, the entire region of the upper surface closely abuts the abutment portion 9. Thereby, heat which is generated in the illumination lamps 34 and the light device 35 is quickly transferred from the upper surface 37*a* of the protrusions 37 to the luminaire main body 2 through the abutment portion 9 and is dissipated from the outer surface 2*c* of the luminaire main body 2 to the external space.

As described above, in the luminaire 1 of the present embodiment, by using the screw 4 which is the mounting member and the coil spring 5 which is the elastic member, the socket device 3 is mounted on the luminaire main body 2 so as to move in the elasticity direction of the coil spring 5. In addition, when the lamp device 6 is mounted on the socket device 3, the protrusion 37 of the lamp device 6 abuts the abutment portion 9 of the luminaire main body 2, and the coil spring 5 is further compressed and presses the lamp device 6 to the abutment portion 9 side. Therefore, closeness between the upper surface 37*a* of the protrusion 37 and the abutment portion 9 of the luminaire main body 2 can be secured. Thereby, it is possible to quickly dissipate the heat generated in the lamp device 6 from the luminaire main body to the external space.

In addition, four receiving portions 18 and four penetrating holes 27 are provided at regular intervals in the circumferential direction of the socket device 3 and the socket device is mounted on the luminaire main body 2 at four places. Therefore, even if a slight difference in the elastic restoring force of the coil spring 5 is present, it is possible to stably mount the lamp device 6. In addition, it is possible to equally and closely contact the upper surface 37*a* of the protrusion 37 to the abutment portion 9 of the luminaire main body 2.

In addition, four engagement receiving portions 17 are formed at regular intervals in the circumferential direction in the inner wall surface 22*c* of the cylindrical portion 22 in the socket device 3 and four engagement portions 40 are formed at regular intervals in the circumferential direction in the outer wall surface 37*b* of the protrusion 37 in the lamp device 6. Therefore, when the engagement portions 40 are engaged with the engagement receiving portions 17, the lamp device 6 can be stably mounted on the socket device 3.

Moreover, in addition to the pair of connection holes 20 and the carriers 21 and 21 for power feeding, the other pair of connection holes 29 and 29 and carriers 30 and 30 for dimming of the illumination lamps 34 are provided in the socket device 3, and the pair of connection pins 38 and 38 and the other pair of connection pins 39 and 39 are provided in the lamp device 6. Therefore, the light device 35 can dimly light the illumination lamps 34 by the light control signal from the light control device in the outside, and thus, it is possible to vary the brightness of the surface to be irradiated as desired.

Second Embodiment

Figure 6:
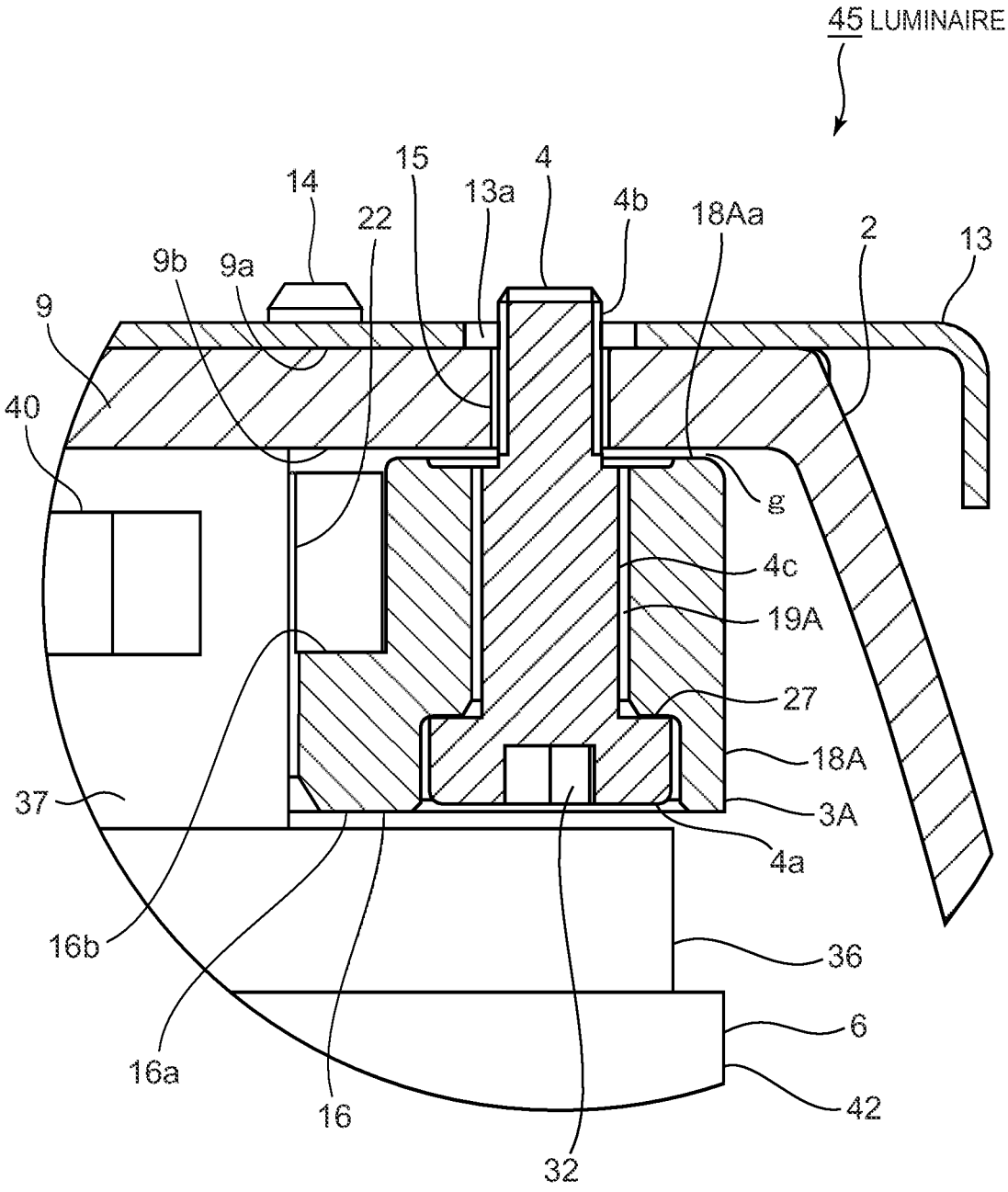
FIG. 6 is a partially schematic vertical cross-sectional view of a luminaire showing a second embodiment of the present invention.
Figure 7:
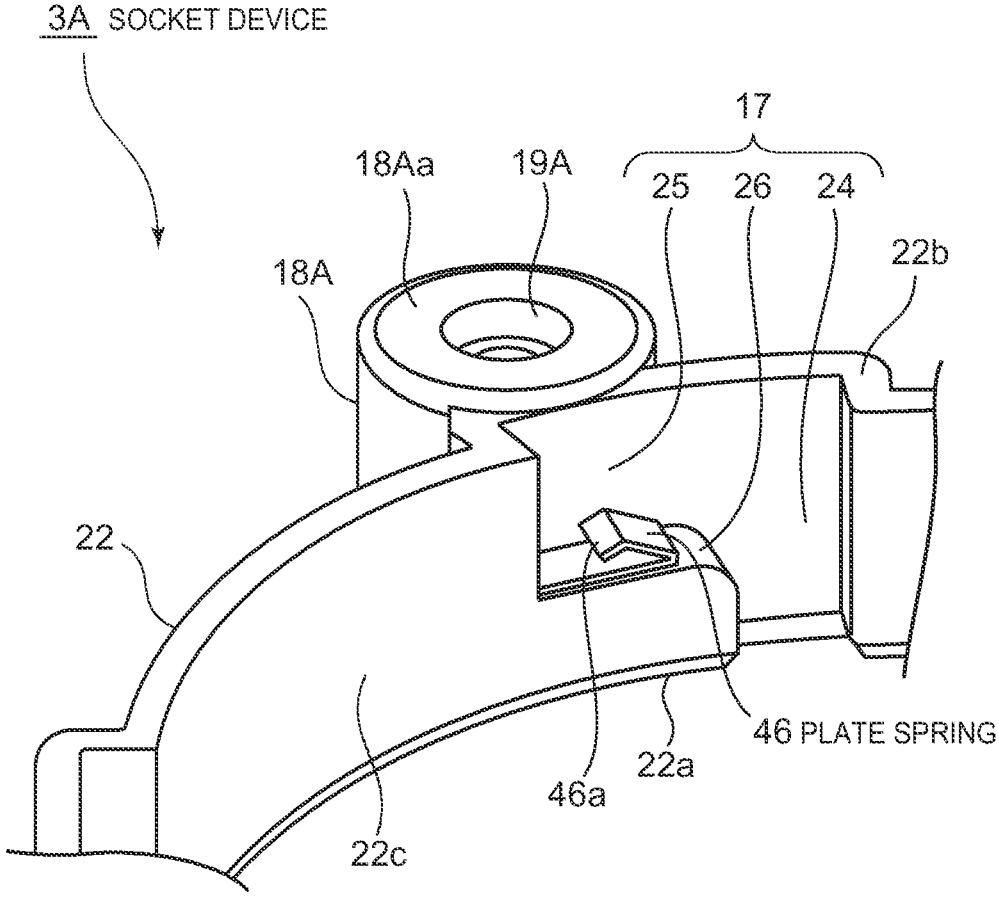
FIG. 7 shows a schematic perspective view showing a portion of an inner wall surface of a socket device in the second embodiment.

FIGS. 6 and 7 show a second embodiment of the present invention, FIG. 6 is a partially schematic vertical cross-sectional view of a luminaire, and FIG. 7 shows a schematic perspective view showing a portion of an inner wall surface of a socket device. In addition, the same portions as those of FIGS. 2 and 4 are denoted by the same reference numerals, and the descriptions are omitted.

In a luminaire 45 shown in FIG. 6, a socket device 3A is mounted on the luminaire main body 2 by the screw 4 in the luminaire 1 shown in FIG. 2. In receiving portions 18A, a large diameter portion of a penetrating hole 19A is formed so as to receive the head portion 4*a* of the screw 4. Moreover, the screwed portion 4*b* is screwed to the screw hole 15 of the luminaire main body 2 until the head portion 4*a* of the screw 4 abuts the step portion 27. At this time, the gap g may be provided between an upper surface 18Aa of the receiving portion 18A and the inner surface 9*b* of the abutment portion 9 of the luminaire main body 2, and the upper surface 18Aa may abut the inner surface 9*b*.

In addition, as shown in FIG. 7, in the socket device 3A, a plate spring 46 is provided in the one surface 22*a* side of the cylindrical portion 22 in the horizontal groove portion 25 of the engagement receiving portion 17 of the cylindrical portion 22. A tip 46*a* side of the plate spring 46 is pressed when the engagement portion 40 of the lamp device 6 is engaged with the horizontal groove portion 25. Moreover, reaction (elastic restoring force) against the pressing force acts on the engagement portion 40.

The engagement portion 40 is pressed to the luminaire main body 2 side by the reaction of the plate spring 46, and therefore, the lamp device 6 is pressed to the luminaire main body 2 side. Thereby, the upper surface 37*a* of the protrusion 37 closely abuts the abutment portion 9 of the luminaire main body 2. The heat which is generated in the lamp device 6 is quickly transferred from protrusion 22 to the luminaire main body 2 and is dissipated from the outer surface 2*c* of the luminaire main body 2 to the external space.

In this way, the luminaire 45 of the present embodiment is configured so that the plate spring 46 which is provided in the engagement receiving portions 17 of the socket device 3A presses the lamp device 6 to the luminaire main body 2 side.

Therefore, the upper surface 37*a* of the protrusion 37 can closely abut the abutment portion 9 of the luminaire main body 2, and thus, the heat generated in the lamp device 6 can be quickly dissipated from the luminaire main body to the external space.

Third Embodiment

Figure 8:
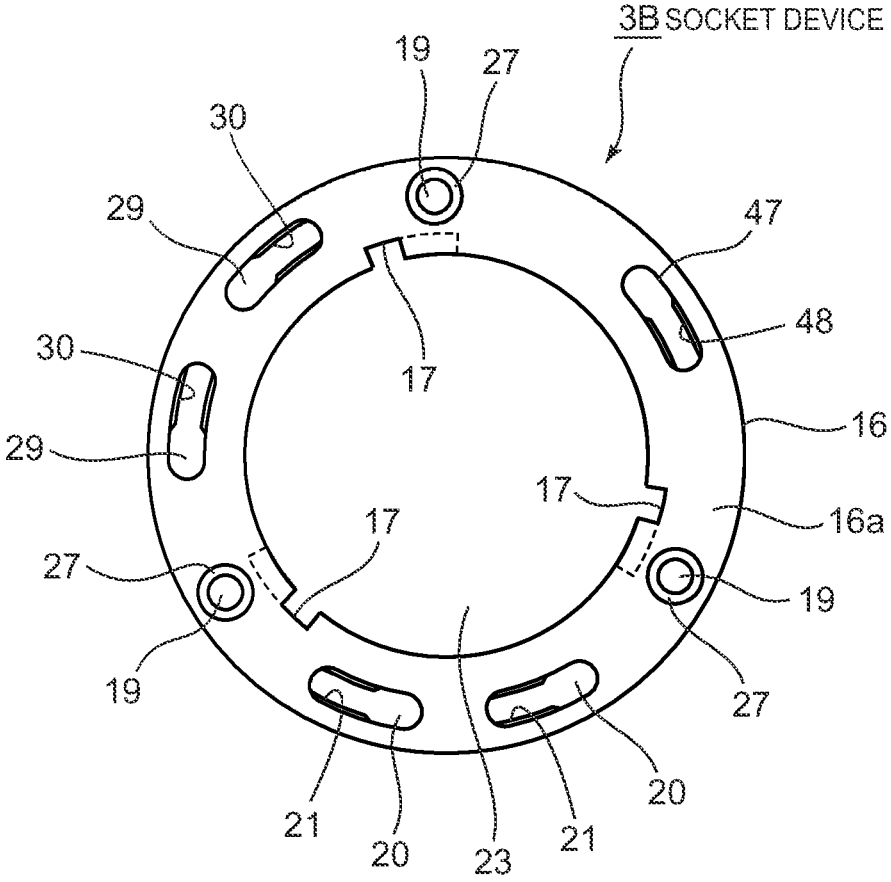
FIG. 8 is a schematic bottom view of a socket device showing a third embodiment of the present invention.
Figure 9A:
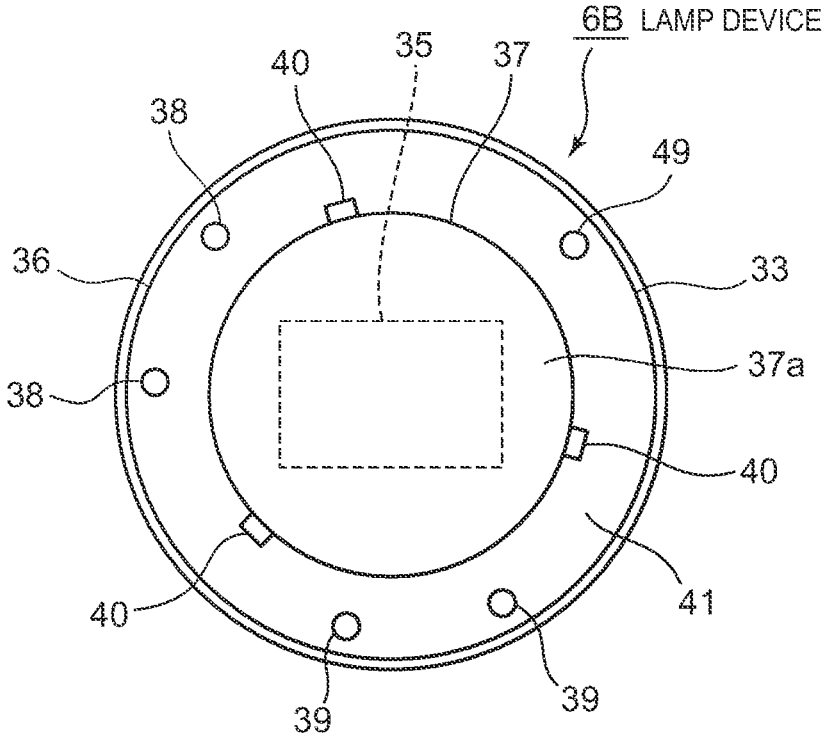
FIG. 9 shows a lamp device in the third embodiment, (*a*) is a schematic top view, and (*b*) is a schematic side view.
Figure 9B:
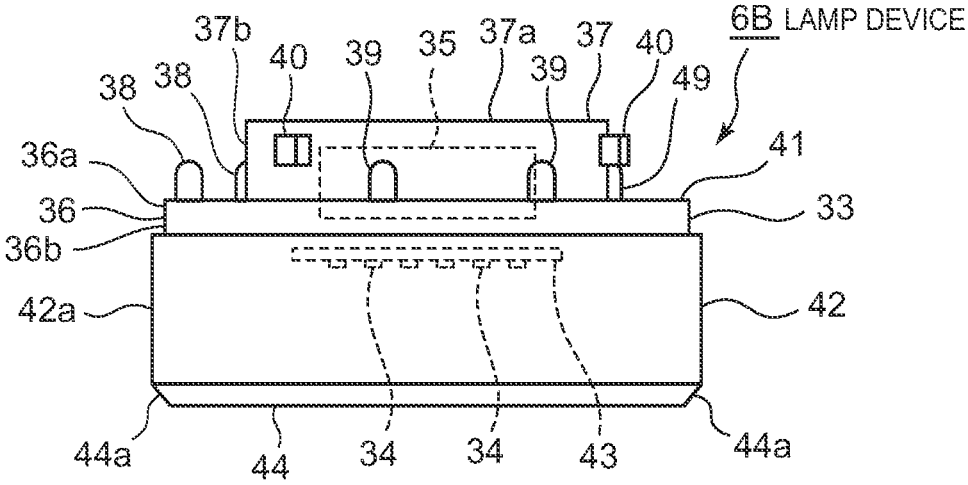

FIGS. 8 and 9 show a third embodiment of the present invention, FIG. 8 is a schematic bottom view of a socket device, and FIG. 9 shows a lamp device, (*a*) is a schematic top view, and (*b*) is a schematic side view. In addition, the same portions as those of FIGS. 3 and 5 are denoted by the same reference numerals, and the descriptions are omitted.

In a socket device 3B shown in FIG. 8, three receiving portions 18 and three penetrating holes 19 are provided at regular intervals in the circumferential direction of the cylindrical portion 22 in the socket device 3 shown in FIG. 3. Therefore, the socket device 3B is mounted on the luminaire main body 2 in three places by the screws 4 and the coil springs 5 which are attachment means. Moreover, similarly, three engagement receiving portions 17 are provided at regular intervals in the circumferential direction of the cylindrical portion 22. Therefore, in the socket device 3B, the engagement portions 40 are engaged in three places.

Moreover, among three penetrating holes 19 (receiving portions 18) in the circumferential direction of the socket main body 16, the pair of connection holes 20 and 20 and carriers 21 and 21, the pair of connection holes 29 and 29 and the carriers 30 and 30, and one connection hole 47 and one carrier 48 are each provided. The connection hole 47 and the carrier 48 are formed similarly to the pair of connection holes 20 and 20 and carriers 21 and 21. The carrier 48 is connected to a ground wire which is introduced into the socket device 3B.

In a lamp device 6B shown in FIG. 9, three engagement portions 40 corresponding to the engagement receiving portions 17 of the socket device 3B are provided in the circumferential direction at regular intervals in the outer wall surface 37*b* of the protrusion 37 in the lamp device 6 shown in FIG. 5. Moreover, the pair of connection pins 38 and 38 which is inserted into the pair of connection holes 20 and 20 of the socket device 3B and is electrically connected to the carriers 21 and 21, the pair of connection pins 39 and 39 which is inserted into the pair of connection holes 29 and 29 and is electrically connected to the carriers 30 and 30, and a connection pin 49 which is inserted into the connection hole 47 and is electrically connected to the carrier 48 are protruded on the upper surface 41 of the base 36. The connection pin 49 is formed similarly to the pair of connection pins 38 and 38 and is electrically connected to the light source main body 42 which is formed of metal, for example.

In the luminaire of the present embodiment, since three receiving portions 18 and three penetrating holes 27 are provided at regular intervals in the circumferential direction and the socket device 3 is mounted on the luminaire main body 2 at three places, even when the socket device is mounted on the luminaire main body 2 by using the attachment means of the screw 4 and the coil spring 5 and a slight difference in the elastic restoring force of the coil spring 5 is present, it is possible to stably mount the lamp device 6. In addition, it is possible to equally and closely contact the upper surface 37*a* of the protrusion 37 close to the abutment portion 9 of the luminaire main body 2.

In addition, three engagement receiving portions 17 are formed at regular intervals in the circumferential direction in the inner wall surface 22*c* of the cylindrical portion 22 in the socket device 3 and three engagement portions 40 are formed at regular intervals in the circumferential direction in the outer wall surface 37*b* of the protrusion 37 in the lamp device 6. Therefore, when the engagement portions 40 are engaged with the engagement receiving portions 17, the lamp device 6 can be stably mounted on the socket device 3.

Moreover, since the luminaire of the present embodiment is configured so that the light control signal is input to the light device 35 from the light control device of the outer portion and the lamp device 6B is connected to the ground wire of the outer portion, the illumination lamps 34 can be dimly lighted, the lamp device 6B can be ground, and therefore, the luminaire of the present embodiment includes effects in which safety with respect to an electric shock is improved.

As described above, the embodiments of the present invention are described with reference to specific examples. However, the present invention is not limited to the specific examples.

Figure 10:
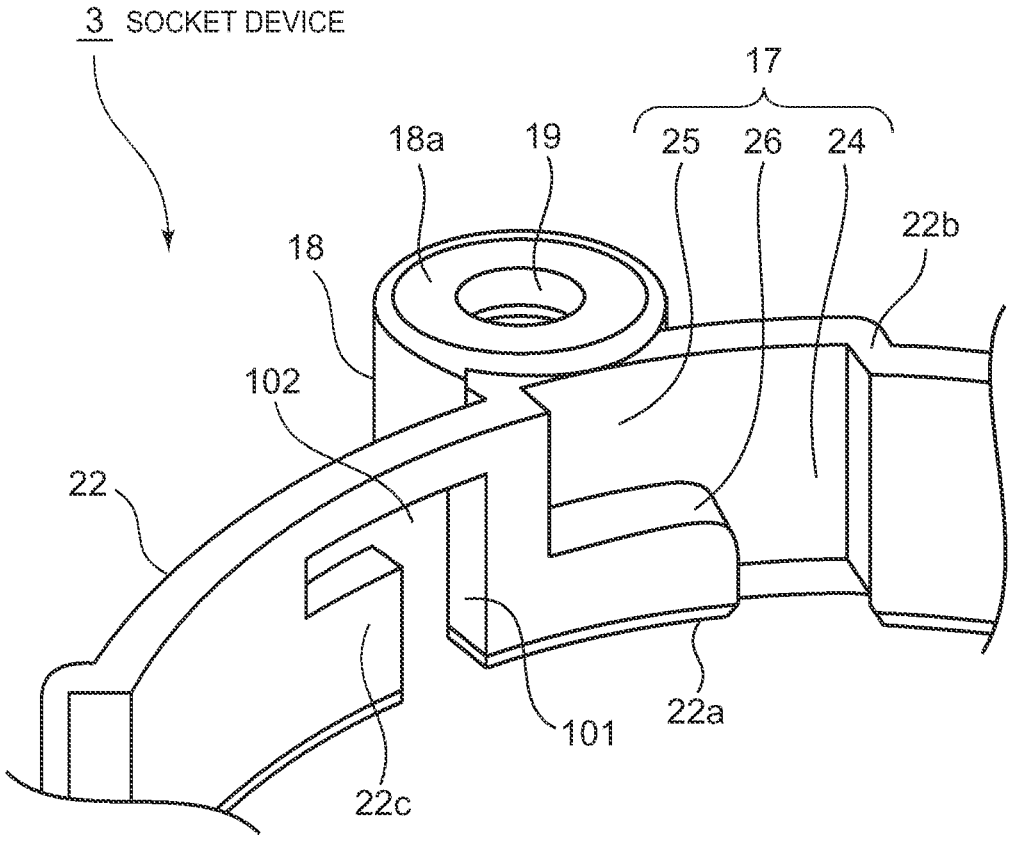
FIG. 10 is a schematic perspective view showing a portion of an inner wall surface of the socket device.

For example, the pair of connection pins 38 and 38 and the other pair of connection pins 39 and 39 protrude by a predetermined length upward from the flat surface portion 41 of the base 36. However, the connection pins which protrude in a horizontal direction from the outer wall surface 37*b* of the protrusion 37 of the lamp device 6 may be provided. In this case, as shown in FIG. 10, a notch is provided from the lower surface 21*a* side of the inner wall surface 22*c* in the socket device 3. The notch portion includes a vertical notch portion 101 for when the connection pins are inserted and a horizontal notch 102 which communicates with the vertical notch portion 101 and is provided so that the connection pins move in the rotation direction of the lamp device 6.

Some embodiments of the present invention are described. However, the embodiments are presented as an example and are not intended to limit the scope of the invention. These novel embodiments can be embodied in other various forms, and various omissions, replacements, and changes can be performed within a scope which does not depart from the gist of the invention. These embodiments or the modifications are included to the scope or the gist of the invention and are included in a scope of the invention described in claims and equivalent thereof.

REFERENCE SIGNS LIST

1, 45: luminaire
2: luminaire main body
3, 3A, and 3B: socket device
4: screw which is attachment means
5: coil spring which is attachment means
6 and 6B: lamp device
46: plate spring which is attachment means

The invention claimed is:

1. A luminaire comprising:

a luminaire main body that includes an abutment portion in which heat is transferred, and a mounting receiving portion;

a socket device that includes a socket main body having an opening portion, an engagement receiving portion which is provided in the opening portion, a mounting member which is fixed to the mounting receiving portion, an elastic member receiving portion which receives an elastic member generating an elastic force between the socket main body and the mounting member, and a connection portion which is electrically connected to an external power source, and is mounted so as to move in an elasticity direction of the elastic member with respect to the luminaire main body by the mounting member; and a lamp device that includes a contact portion which contacts the abutment portion, an engagement portion which engages with the engagement receiving portion, and a lamp side connection portion which is electrically connected to the connection portion, wherein, the mounting member comprises a threaded portion, an intermediate portion and a head portion in which the diameter of the intermediate portion is smaller than that of the head portion and is larger than that of the threaded portion, and the intermediate portion sets the mounting position of the mounting member relative to the luminaire main body, the threaded portion of the mounting member is accommodated in the mounting receiving portion so that the head portion of the mounting member is not protruded from the socket main body, the elastic member generates the elastic force between the socket main body and the head portion of the mounting member, and the abutment portion of the luminaire main body and the contact portion of the lamp device contact each other by the elastic force of the elastic member when the engagement portion of the lamp device and the engagement receiving portion of the socket device are engaged with each other.

2. The luminaire according to claim 1, wherein the mounting member is accommodated in the elastic member receiving portion so that the socket device is not protruded from a side on which the lamp device is mounted when the socket device is mounted on the luminaire main body.

3. The luminaire according to claim 1, wherein a plurality of the elastic member receiving portions and a plurality of the connection portions are provided on the socket device, the connection portions are disposed between the elastic member receiving portions, the connection portions include a connection hole and a carrier, and the carrier is disposed at a position away from a receiving position of the connection hole.

4. The luminaire according to claim 1, wherein the socket device includes a disk-shaped socket main body in which the opening portion is formed in a center region, and the elastic member receiving portion and the connection portion are provided on a circumference of the socket main body.

5. The luminaire according to claim 1, wherein the connection portion includes a power connector which is provided in the socket main body, and the elastic member receiving portion is not positioned on an extension of a power line which is extended from the power connector.

6. A socket device comprising:

a socket main body having an opening portion;

an engagement receiving portion which is provided in the opening portion and engages with a lamp device;

a mounting member which is fixed to a luminaire main body;

an elastic member receiving portion which receives an elastic member generating an elastic force between the socket main body and the mounting member; and a connection portion which is electrically connected to an external power source, wherein, the mounting member comprises a threaded portion, an intermediate portion and a head portion in which the diameter of the intermediate portion is smaller than that of the head portion and is larger than that of the threaded portion, and the intermediate portion sets the mounting position of the mounting member relative to the luminaire main body, the threaded portion of the mounting member is accommodated in the mounting receiving portion so that the head portion of the mounting member is not protruded from the socket main body, the elastic member generates the elastic force between the socket main body and the head portion of the mounting member, and the socket device is mounted so as to move in an elasticity direction of the elastic member with respect to the luminaire main body by the mounting member.

7. The socket device according to claim 6, wherein the mounting member is accommodated in the elastic member receiving portion so that the socket device is not protruded from a side on which the lamp device is mounted when the socket device is mounted on the luminaire main body.

8. The socket device according to claim 6, wherein a plurality of the elastic member receiving portions and a plurality of the connection portions are provided on the socket device, the connection portions are disposed between the elastic member receiving portions, the connection portions include a connection hole and a carrier, and the carrier is disposed at a position away from a receiving position of the connection hole.

9. The socket device according to claim 6, wherein the socket device includes a disk-shaped socket main body in which the opening portion is formed in a center region, and the elastic member receiving portion and the connection portion are provided on a circumference of the socket main body.

10. The socket device according to claim 6, wherein the connection portion includes a power connector which is provided on the socket main body, and the elastic member receiving portion is not positioned on an extension of a power line which is extended from the power connector.

11. An electric appliance comprising:

a luminaire main body that includes an abutment portion in which heat is transferred, and a mounting receiving portion; and a socket device that includes a socket main body having an opening portion, an engagement receiving portion which is provided in the opening portion, a mounting member which is fixed to the mounting receiving portion, an elastic member receiving portion which receives an elastic member generating an elastic force between the socket main body and the mounting member, and a connection portion which is electrically connected to an external power source, and is mounted so as to move in an elasticity direction of the elastic member with respect to the luminaire main body by the mounting member, wherein, the mounting member comprises a threaded portion, an intermediate portion and a head portion in which the diameter of the intermediate portion in smaller than that of the head portion and is larger than that of the threaded portion, and the intermediate portion sets the mounting position of the mounting member relative to the luminaire main body, the threaded portion of the mounting member is accommodated in the mounting receiving portion so that the head portion of the mounting member is not protruded from the socket main body, and the elastic member generates the elastic force between the socket main body and the head portion of the mounting member.

12. The electric appliance according to claim 11, wherein the mounting member is accommodated in the receiving portion of the elastic member so that the socket device is not protruded from a side on which the lamp device is mounted in a state where the socket device is mounted on the luminaire main body.

13. The electric appliance according to claim 11, wherein a plurality of the elastic member receiving portions and a plurality of the connection portions are provided on the socket device, the connection portions are disposed between the elastic member receiving portions, the connection portions include a connection hole and a carrier, and the carrier is disposed at a position away from a receiving position of the connection hole.

14. The electric appliance according to claim 11, wherein the socket device includes a disk-shaped socket main body in which the opening portion is formed in a center region, and the elastic member receiving portion and the connection portion are provided on a circumference of the socket main body.

15. The electric appliance according to claim 11, wherein the connection portion includes a power connector which is provided in the socket main body, and the elastic member receiving portion is not positioned on an extension of a power line which is extended from the power connector.

* * * * *